US008060972B2

(12) United States Patent
Geiberger et al.

(10) Patent No.: US 8,060,972 B2
(45) Date of Patent: Nov. 22, 2011

(54) TOOTHBRUSH

(75) Inventors: Christoph Geiberger, Koenigswinter (DE); Klaus Reinbold, Buehl (DE)

(73) Assignee: GlaxoSmithkline Consumer Healthcare GmbH & Co., Buehl (Baden) (DE)

( * ) Notice: Subject to any disclaimer, the term of this patent is extended or adjusted under 35 U.S.C. 154(b) by 927 days.

(21) Appl. No.: 11/993,106

(22) PCT Filed: Jun. 29, 2006

(86) PCT No.: PCT/EP2006/006414

§ 371 (c)(1), (2), (4) Date: Dec. 19, 2007

(87) PCT Pub. No.: WO2007/003387

PCT Pub. Date: Jan. 11, 2007

(65) Prior Publication Data

US 2010/0242196 A1 Sep. 30, 2010

(30) Foreign Application Priority Data

Jul. 1, 2005 (GB) ..... 0513537.1

(51) Int. Cl.
*A46B 9/04* (2006.01)

(52) U.S. Cl. ..... 15/167.1; 15/143.1

(58) Field of Classification Search ..... 15/143.1, 15/167.1

See application file for complete search history.

(56) References Cited

U.S. PATENT DOCUMENTS

| | | | | |
|---|---|---|---|---|
| D163,707 | S * | 6/1951 | Pifer | D4/104 |
| 5,054,154 | A | 10/1991 | Schiffer et al. | |
| 5,735,012 | A | 4/1998 | Heinzelman et al. | |
| D401,069 | S * | 11/1998 | Lamond et al. | D4/104 |
| 6,292,973 | B1 * | 9/2001 | Moskovich et al. | 15/167.1 |
| 6,367,112 | B1 * | 4/2002 | Moskovich et al. | 15/167.1 |
| 6,749,788 | B1 * | 6/2004 | Holden et al. | 264/247 |
| 2002/0138931 | A1 * | 10/2002 | Davies | 15/167.1 |

FOREIGN PATENT DOCUMENTS

| | | | |
|---|---|---|---|
| DE | 44 20 738 | C1 | 10/1995 |
| DE | 198 58 102 | A1 | 6/2000 |
| EP | 0 336 641 | | 3/1989 |
| EP | 0339 350 | A | 11/1989 |
| WO | WO97/29663 | A | 8/1997 |

* cited by examiner

*Primary Examiner* — Monica Carter
*Assistant Examiner* — Stephanie Newton
(74) *Attorney, Agent, or Firm* — Joshua C. Sanders; Nora L. Stein; Theodore R. Furman

(57) ABSTRACT

A toothbrush which comprises a handle comprising at least three longitudinally elongate flexible spines arranged at the apexes of a polygon, the space between the spines containing an elastomer material which links the spines.

8 Claims, 1 Drawing Sheet

TOOTHBRUSH

Figure 1:
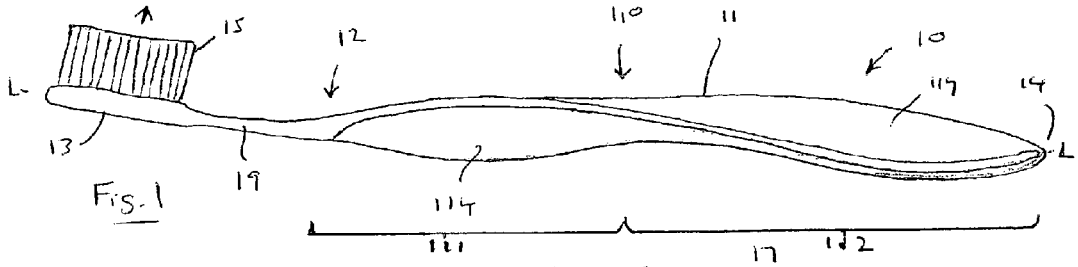

This application is a §371 national phase entry of International Application No. PCT/EP2006/006414 filed Jun. 29, 2006.

This invention relates to toothbrushes, in particular to a toothbrush handle construction.

Toothbrushes are well-known articles and normally comprise a head and a grip handle, generally with a narrowed neck region in between, all arranged along a longitudinal head-handle direction. Normally toothbrushes are made primarily of a rigid plastic material, e.g. a polypropylene or styrol acryl nitrol ("SAN"). Many are so called two-component toothbrushes comprising a part made of such a plastic, e.g. the head and the main structure of the handle and any intermediate neck made integrally, termed herein a "skeleton", and a part made of a softer resilient elastomer, such as a thermoplastic elastomer e.g. Santoprene™ e.g. comprising part of the grip handle, to enhance grip, aesthetic appearance or to influence flexibility. Such toothbrushes are disclosed for example in U.S. Pat. No. 5,054,154, U.S. Pat. No. 6,292,973, U.S. Pat. No. 5,735,012 and EP-A-0 336 641 among others.

Toothbrush heads generally incorporate oral hygiene parts such as bristles, which project from the head in a bristle direction. Such oral hygiene parts are generally elongate, and the term "bristle direction" as used herein refers to the elongation direction of elongate oral hygiene parts of any type.

Toothbrushes are normally made by a process in which the hard plastic material part of their structure, the "skeleton" is first made, generally by injection moulding. Then this plastic part is enclosed in a mould cavity which defines the shape of the elastomer material part, and the elastomer material of the second component in a fluid state is injected into this mould cavity to form the elastomer material part. Normally the plastic material skeleton is formed with one or more cavity to receive this second material.

There are ongoing problems of improving toothbrushes, for example to improve the ability of toothbrushes to absorb excessive toothbrushing forces, to adapt to the contours of a user's hand, and to have an improved feel in the user's hand. The present invention attempts to address these problems. Other objects and advantages of the present invention will be apparent from the following description.

According to this invention a toothbrush comprises an elongate handle with a first end connected to or connectable to a toothbrush head, and a longitudinally opposite second end, the handle comprising at least three longitudinally elongate flexible spines arranged at the apexes of a polygon constructed in a plane perpendicular to the longitudinal direction, the space between the spines containing an elastomer material which links the spines.

Suitably two or more, preferably all, the spines meet adjacent to the first and second ends of the handle. Suitably the spines are integrally made with each other and with the head of the toothbrush and with a neck part between the handle and the head.

For example in an embodiment there may be three such spines arranged at the apexes of a polygon being a triangle. Such a triangle is suitably equilateral or isosceles. With an isoceles triangle the bisector between the two identical sides is suitably oriented in or opposite to the bristle direction.

For example in an embodiment there may be a longitudinally intermediate point between the first and second ends, a first part of the handle being between the first end and the intermediate point, and a second part of the handle being between the second end and the intermediate point, and the respective orientations of the polygons in the first and second parts may be inverted along an inversion axis perpendicular to the longitudinal direction. In such an embodiment the respective polygons may have different dimensions in the two parts.

For example in this embodiment the head may have tooth cleaning elements such as bristles projecting therefrom in a direction (the "bristle direction") transverse to the longitudinal direction, and the inversion axis may be parallel to the direction in which the tooth cleaning elements project. For example the polygon may be a triangle, and in the first part the base-apex direction may point in a direction opposite to the bristle direction, and in the second part the base-apex direction may point in the bristle direction.

In this embodiment, along the longitudinal direction the spines may follow a wave-like profile, so that at a longitudinally intermediate point between the first and second ends the spines cross a constructed plane in which the two ends lie. Such a plane may be generally perpendicular to the orientation of the tooth cleaning elements from the head, e.g. bristles.

The spines, and preferably the head and any neck part are preferably made of a typical plastics material such as polypropylene or polyamide from which toothbrushes are conventionally made. The elastomer material is suitably a thermoplastic elastomer material of the type conventionally used in toothbrushes, e.g. a so called "Santoprene" material. The elastomer material is suitably a soft material e.g. typically having a Shore A hardness in the range 5-30, typically ca. 20.

The toothbrush handle disclosed herein is suitable for known types of toothbrush head. The term "toothbrush head" herein includes heads incorporating bristles, elastomer oral hygiene parts and other oral hygiene parts.

The toothbrush of this invention may be made by a conventional process of injection moulding in which firstly plastics material parts of the toothbrush are made by an injection moulding process, then in a second stage these plastics material parts of the toothbrush are enclosed in an injection mould and the elastomer material part of the toothbrush formed in contact with the plastic material parts. By selection of the injection moulding pressure and temperature in this second stage the elastomer material can be made to bond securely to the plastic material.

The toothbrush handle construction of this invention can provide improved flexibility of the handle in adjusting to the hand of the user.

Figure 3:
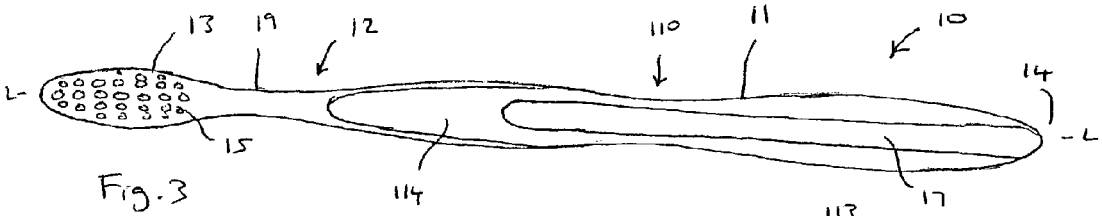

The invention will now be described by way of example only with reference to:

FIGS. 1 and 3 which respectively show side and plan views of a toothbrush of this invention.

Figure 2:
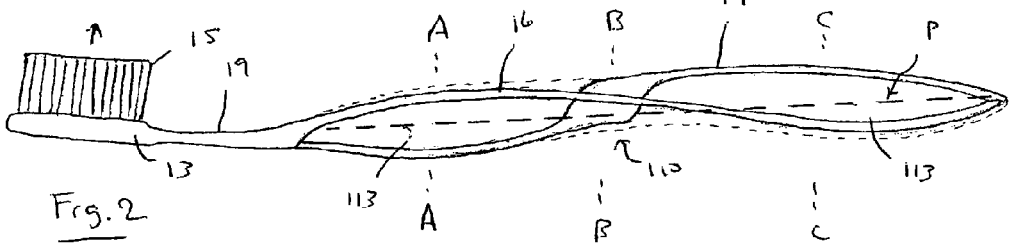
Figure 4:
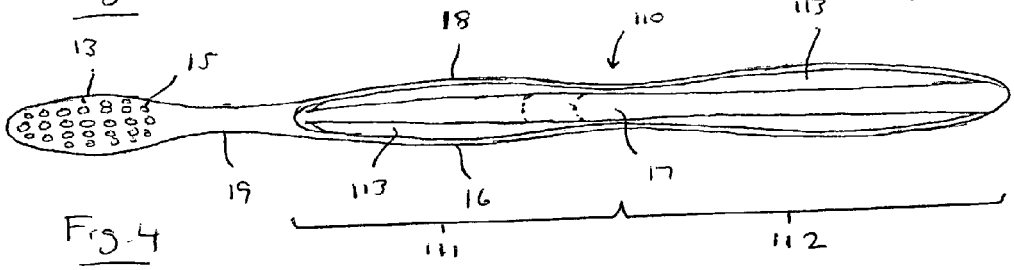

FIGS. 2 and 4 which show views corresponding to FIGS. 1 and 3 of the plastic material skeleton of the toothbrush of the invention, without the elastomer present.

Figure 5:
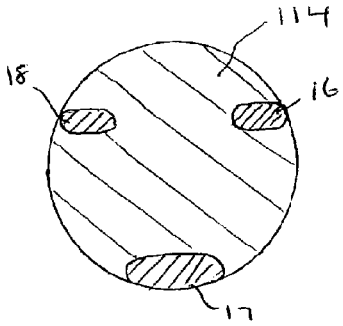
Figure 6:
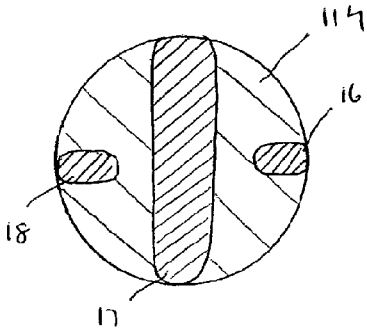
Figure 7:
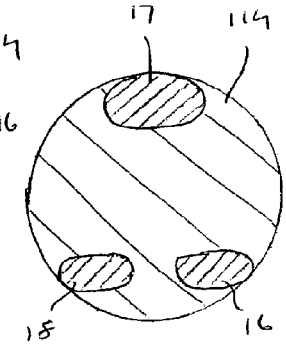

FIGS. 5, 6 and 7 which respectively show cross sections at lines A-A, B-B and C-C.

Referring to FIGS. 1 and 3, a toothbrush 10 overall is shown, which comprises an elongate handle 11 with a first end 12 connected to a toothbrush head 13, and a longitudinally opposite second end 14. The toothbrush 10 has an overall longitudinal direction L-L along which the head and handle lie. The head 13 has tooth cleaning elements 15 being bristles projecting from the head in a direction (the "bristle direction") perpendicular to the longitudinal direction L-L indicated by the arrow.

As more clearly seen in FIGS. 2, 4, 5, 6 and 7 the handle 11 comprises three longitudinally elongate flexible spines 16, 17, 18 arranged at the apexes of an isosceles triangle constructed in a plane perpendicular to the longitudinal direction L-L. The head 13 and spines 16, 17, 18 are made integrally of a plastics material such as a grade of polypropylene as typically used for toothbrushes. The spines 16, 17, 18 are generally rectangular in cross section and are ca. 1-2 mm thick. All three of the spines meet adjacent to the first and second ends 12, 14 of the handle 11. The section at B-B shown in FIG. 6 shows that the spines 16, 17, 18 are unconnected at this point but in an alternative construction they may be integrally connected here. Although shown as circular in section the handle 11 may have any cross section convenient or comfortable for a user to hold the toothbrush handle.

There is a neck part 19 between the handle 11 and the head 13 also made integrally of the plastics material.

There is a longitudinally intermediate point 110 between the first 12 and second end 14 of handle 11, a first part 111 of the handle 11 being between the first end 12 and the intermediate point 110, and a second part 112 of the handle 11 being between the second end 14 and the intermediate point 110. As seen more clearly in FIG. 5, in the first part 111 of the handle 11 the triangular arrangement of the spines 16, 17, 18 is oriented with an apex pointing in a direction opposite to the bristle direction shown by the arrow. As is seen more clearly in FIG. 7, in the second part 112 of the handle 11 the triangular arrangement of the spines 16, 17, 18 is oriented with an apex pointing in the bristle direction shown by the arrow, so that the respective orientations of the triangular arrangements in the two parts 111, 112 is inverted along an inversion axis perpendicular to the longitudinal direction L-L, and parallel to the bristle direction. However the two triangles have different dimensions such as lengths of their sides in the two parts 111, 112, and the relative orientation of the two triangles may be vice-versa to that shown.

It is seen that along the longitudinal direction the spines 16, 17, 18 follow a smoothly curved wave-like profile, so that at a longitudinally intermediate point between the two ends 12, 14 the spines 16, 17, 18 cross a constructed plane (shown by the dashed line "P" in FIG. 2) in which the two opposite ends 12, 14 lie. The plane P is generally perpendicular to the orientation of the bristles 15 from the head 13.

The space 113 between the spines 16, 17, 18 contains an elastomer material 114 which links the spines 16, 17, 18, and which defines the outer shape of the toothbrush handle with bulbous end parts 111, 112 and a narrowed waist about the intermediate point 110. The elastomer material 114 is a thermoplastic elastomer material of the type conventionally used in toothbrushes, e.g. a so called "Santoprene" material. The elastomer material is suitably a soft material e.g. typically having a Shore A hardness in the range 5-30, typically ca. 20. The elastomeric material 114 may be a transparent or translucent material, coloured or colourless, so that the internal structure of the toothbrush, i.e. the three spines 16, 17, 18 can be seen as an aesthetic feature.

The toothbrush of this invention has been made by a process of injection moulding in which firstly plastics material parts 13, 16, 17, 18, 19 are made by an injection moulding process, then in a second stage at least the plastics material parts 16, 17, 18 of the toothbrush are enclosed in an injection mould and the elastomer material part 114 of the toothbrush is formed in contact with the plastic material parts 16, 17, 18. By selection of the injection moulding pressure and temperature in this second stage the elastomer material 114 can be made to bond securely to the plastic material parts 16, 17, 18.

It is seen that the spines 16, 17, 18 are thin enough to be flexible under hand pressure applied by the user, and this flexibility is enhanced by the presence of the elastomer material 114.

The invention claimed is:

1. A toothbrush which comprises an elongate handle with a first end connected to a toothbrush head from which tooth cleaning elements projecting in a bristle direction transverse to the longitudinal direction, to define a longitudinal head-handle direction and with a longitudinally opposite second end, with a neck part longitudinally between the head and handle, there being a longitudinally intermediate point between the first and second ends, a first part of the handle being between the first end and the intermediate point, and a second part of the handle being between the second end and the intermediate point, the handle comprising at least three longitudinally elongate flexible spines each arranged at the apexes of a polygon constructed in a plane perpendicular to the longitudinal direction and defining a space between the spines, the respective orientations of the polygons in the respective first and second parts being inverted along an inversion axis perpendicular to the longitudinal direction and parallel to the direction in which the tooth cleaning elements project, the head, handle and spines being made integrally with each other of a plastic material, and the space between the spines containing an elastomer material which links the spines.

2. A toothbrush according to claim 1 wherein two or more of the spines meet adjacent to the first and second ends of the handle.

3. A toothbrush according to claim 2 wherein all the spines meet adjacent to the first and second ends of the handle.

4. A toothbrush according to claim 1 wherein there are three spines arranged at the apexes of a polygon being a triangle having a base-apex direction.

5. A toothbrush according to claim 4 wherein the triangle is equilateral or isosceles.

6. A toothbrush according to claim 4 wherein in the first part of the handle the base-apex direction points in a direction opposite to the bristle direction, and in the second part of the handle the base-apex direction points in the bristle direction.

7. A toothbrush according to claim 1 wherein along the longitudinal direction the spines follow a wave-like profile so that at the longitudinally intermediate point between the two opposite ends the spines cross a constructed plane in which the two ends lie.

8. A toothbrush according to claim 1 wherein the elastomer material is a thermoplastic elastomer material having a Shore A hardness in the range 5-30.

* * * * *